US005489890A

United States Patent [19]

Moser

[11] Patent Number: 5,489,890

[45] Date of Patent: Feb. 6, 1996

[54] PORTABLE ALARM DEVICE FOR ENTRYWAY MOTION MONITORING

[76] Inventor: Terry M. Moser, 3535 E. Coast Hwy., #327, Corona Del Mar, Calif. 92625

[21] Appl. No.: 390,697

[22] Filed: Feb. 17, 1995

[51] Int. Cl.[6] ..... G08B 13/08

[52] U.S. Cl. ..... 340/545; 200/61.93; 340/546; 340/548

[58] Field of Search ..... 340/548, 546, 340/545; 200/61.93

[56] References Cited

U.S. PATENT DOCUMENTS

| | | | |
|---|---|---|---|
| 882,570 | 3/1908 | Liaci | 340/548 |
| 3,175,207 | 3/1965 | Hewitt, Jr. | 340/546 |
| 3,427,608 | 2/1969 | Green | 200/61.93 |
| 4,149,156 | 4/1979 | Blasucci | 340/546 |
| 4,205,305 | 5/1980 | Nakada | 340/548 |
| 4,206,452 | 6/1980 | Blasucci | 340/548 |
| 4,222,042 | 9/1980 | Cantley | 340/546 |
| 4,284,982 | 8/1981 | Downey | 340/548 |
| 4,292,629 | 9/1981 | Kerr et al. | 340/545 |
| 4,533,904 | 8/1985 | Steinman, Jr. | 340/548 |

*Primary Examiner*—Glen Swann
*Attorney, Agent, or Firm*—Roy A. Ekstrand

[57] ABSTRACT

A generally rectangular housing defines an interior cavity therein. A conventional battery powered alarm circuit is supported within the interior cavity. A supporting suction cup is securable to the housing to permit attachment of the housing to a convenient surface. The housing defines an elongated slot in proximity to the circuit battery and a pair of spring contacts are provided for completing the battery power circuit connection to the alarm circuitry. An insulating tab is receivable within the alarm housing through the slot and extends between one of the spring contacts and its associated battery terminal to interrupt the battery power to the alarm circuit. The insulative tab is coupled to a second suction cup by a flexible line. The alarm system is installed by positioning the alarm housing and the second suction cup on opposite sides of a movable door or window portion. The alarm is triggered as the second suction cup is moved drawing the insulative tab outwardly from the alarm housing and permitting the completion the battery power circuit to the alarm circuit.

6 Claims, 2 Drawing Sheets

PORTABLE ALARM DEVICE FOR ENTRYWAY MOTION MONITORING

FIELD OF THE INVENTION

This invention relates generally to alarm systems and particularly to those utilized to protect door and window building access points.

BACKGROUND OF THE INVENTION

Security and alarm systems have been provided through the years in a variety of configurations all directed to protecting a dwelling, office or similar environment against undesired intrusion. Alarm system vary in complexity from relatively simple entry detection systems to extremely complex computer control programmable systems. In many instances, security and alarm systems provide for automatic alert of a remote monitoring station or facility.

The great increase in travel patterns undertaken and exhibited by the population generally through the years has created a substantial need for relatively simple low cost and easily operated and installed alarm systems which are, in essence, portable. Such systems usually rely upon battery power and typically include a master unit together with a mechanically coupled second unit in which the master unit senses the separation or movement of the second unit. In such alarm systems, the basic objective is to detect the relative movement or separation between two window portions or between a door and its surrounding frame or support.

Faced with the need for evermore improved personal or portable alarm systems, practitioners in the art have provided a variety of alarm systems. For example, U.S. Pat. No. 882,570 issued to Liaci sets forth a BURGLAR ALARM having an electric circuit, a movable spring controlled contact device within the circuit, connections between the contact device and the point to be protected for actuating the contacts against a resisting spring to close the contact circuit in the event the connections are separated by the movement of the to-be-protected point.

U.S. Pat. No. 4,149,156 issued to Blasucci sets forth a WINDOW ALARM EMPLOYING A RELEASABLY MOUNTED PLUNGER SWITCH in which a plunger switch is releasibly held against the inner surface of the outer section of a double hung window or sliding door by a suction cup. Movement of the inner section with respect to the outer section of the door or window dislodges the suction cup releasing the spring-biased switch therein permitting it to close. The switch is coupled to signaling means which generate an alarm signal upon switch closure.

U.S. Pat. No. 4,205,305 issued to Nakada sets forth a BURGLAR ALARM having a housing which contains a bell assembly and battery compartment connected in series with a switch assembly having a linearly movable element which is displaceable a predetermined threshold distance by a chain extending to a magnet temporarily joined to a metal jacket attached to a movable surface. The switch assembly contains a pivoted contact which moves against a fixed contact when the linearly movable element is displaced a predetermined distance.

U.S. Pat. No. 4,206,452 issued to Blasucci sets forth a TENSION CORD BURGLAR ALARM having a plurality of members attachable to a window or door around which a cord is stretched under tension in the form of a polygon. A switch is positioned within the polygon such that the switch is attached by further cords to two sides of the polygon. The switch is held under a selected tension and the shape of the polygon is such that an intruder cannot enter through the window or door without disturbing the cord polygon and thereby the tension in the switch. The switch is designed to respond to a change in tension applied thereto and to supply a signal to an alarm system.

U.S. Pat. No. 4,222,042 issued to Cantley sets forth a DOOR ALARM which is mounted on the inside of a door adjacent to the hinged edge thereof. The alarm includes a housing having a buzzer and battery power system supported therein. An arming lever is pivotally mounted to the housing and extends outwardly therefrom operatively engaging an actuator block mounted on the door frame adjacent the housing. The lever and conductor are operatively connected to the battery and buzzer to form an alarm circuit which will actuate the buzzer when the door is opened.

U.S. Pat. No. 4,284,982 issued to Downey sets forth a BATTERY-OPERATED PERSONAL ALARM having a withdrawable actuating pin extending from the case thereof. A multi-purpose handle attached to the exterior of the case permits attachment of the alarm to a purse handle or the like in a first position. In a second position, the handle permits attachment of the alarm to a door handle for use as a portable burglar alarm. Removable of the handle from its inverted keyhole shaped aperture on the back of the case permits hanging the alarm from a screw head or nail attached to a fixed support.

U.S. Pat. No. 4,292,629 issued to Kerr, et al. sets forth an ALARM SYSTEM intended to signal an attempted intrusion through an opening frame having movable panels therein. An electrical switch mounted upon one panel has an element responsive to a magnetic field for developing a signal. A magnet mounted on the other panel is productive of a magnetic field which interacts with the element of the switch upon movement between the panels. A signaling device is coupled to the switch and produces an alarm indication when movement is sensed U.S. Pat. No. 4,533,904 issued to Steinman, Jr. sets forth a COMBINATION SMOKE AND BURGLAR ALARM having a housing adapted for mounting on an interior room surface such as a wall or ceiling above a door or window. A releasibly inserted locking pin retains a spring-biased plunger mounted above a pressure actuatable tester switch accessible externally of the housing to maintain the plunger in its cocked condition. A line attached to the releasible pin also attaches to an adjacent door or window such that opening of the door or window increases tension on the line removing the locking pin and releasing the plunger to strike the tester button and actuate the alarm.

While the foregoing described prior art devices have provided some measure of success in providing portable alarm systems, there remains nonetheless a continuing need in the art for evermore improved low cost compactly designed and reliable portable alarm systems.

SUMMARY OF THE INVENTION

Accordingly, it is a general object of the present invention to provide an improved portable alarm system. It is a more particular object of the present invention to provide an improved portable alarm system which may be economically manufactured while providing reliable performance. It is a still more particular object of the present invention to provide an improved portable alarm system which, in addition to being inexpensive to manufacture and reliable in operation is capable of compact manufacture and packaging.

In accordance with the present invention, there is provided for use in detecting motion of a movable entryway, an alarm comprising: a housing defining an interior cavity and an aperture; a first suction cup secured to the housing having an outwardly directed suction cone; an electric-powered audible sound producing circuit supported within the interior cavity; a battery having first and second terminals; first and second spring connectors for coupling the first and second battery terminals respectively to the circuit; an insulating tab having a first end extending partially into the interior cavity through the aperture between the first spring connector and the first battery terminal and a second end external to the housing; a second suction cup; and a flexible line coupled between the second end of the tab and the second suction cup.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1A:
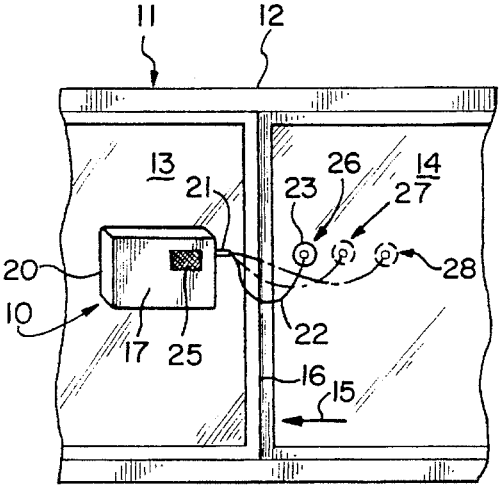
FIGS. 1A and 1B set forth perspective views of a typical installation and operation of the present invention alarm system.
Figure 1B:
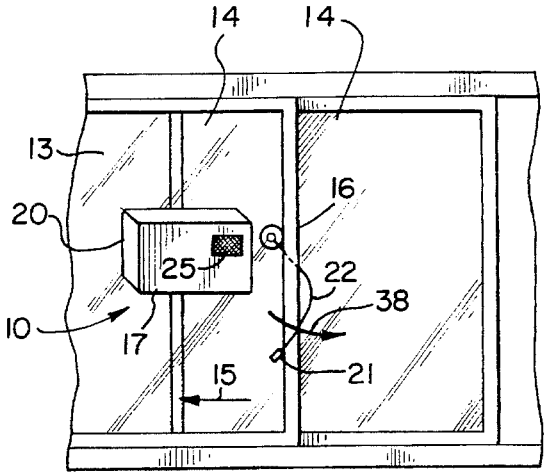

FIGS. 1A and 1B set forth a typical installation of the present invention portable alarm system generally referenced by numeral 10. FIG. 1A sets forth the alarm system and its environment prior to any attempted intrusion. FIG. 1B sets forth the configuration of the present invention alarm system in response to an attempted intrusion into the to-be-protected area.

Specifically, FIG. 1A sets forth a conventional window 11 having a surrounding frame 12 within which a movable pane 14 is secured. Window 11 is of standard construction in that means are provided (not shown) by which movable pane 14 may be moved with respect to frame 12 and pane 13 in the direction indicated by arrow 15 to open window 11.

A portable alarm system constructed in accordance with the present invention and generally referenced by numeral 10 includes a generally rectangular housing 20 having a generally planar cover plate 17 and a speaker grill 25 formed therein. Housing 20 further supports a removable tab 21 having a flexible line 22 coupled thereto. As is better seen in FIG. 5, alarm 10 further includes a suction cup attachment 24 which is secured to the rear surface of housing 20 and secures housing 20 to window pane 13 near the center of window 11. Returning to FIG. 1A, alarm 10 further includes a suction cup 23 attached to the outer end of line 22 and securable to movable pane 14 in accordance with a conventional suction cup attachment.

In operation, with housing 20 firmly secured to window pane within window 11, the installation is completed by securing suction cup 23 to movable pane 14 at the desired position. In the position of suction cup 23 referenced by numeral 26, line 22 is relatively slack. Conversely, with suction cup 23 secured to movable pane 14 at the more extended position shown by reference numeral 28, line 22 approaches a generally taut configuration. Finally, reference numeral 27 identifies an intermediate position for suction cup 23.

In accordance with the intended use of alarm 10, the position of suction cup 23 upon movable pane 14 is selected to determine the degree of motion of movable pane 14 to be tolerated by the alarm system. For example, with suction cup 23 in the position shown by reference numeral 28, movable pane 14 may be opened in the direction of arrow 15 a substantial distance before suction cup 23 moves behind window pane 13 and draws line 22 taut. Conversely, with suction cup 23 secured to movable pane 14 at the position indicated by reference numeral 26, very little, if any, opening motion of movable pane 14 is possible without moving suction cup 23 behind pane 13 and drawing line 22 taut.

Once movable pane 14 has been moved in the direction indicated by arrow 15 a sufficient distance to place line 22 under tension, tab 21 is pulled from housing 20 which, in accordance with the operation of alarm system 10 set forth below in greater detail activates the alarm mechanism within housing 20 causing an audible sound alert.

FIG. 1B sets forth the configuration of alarm system 10 following the movement of movable pane 14 beyond the alarm trigger point. Thus, as movable pane 14 has moved in the direction indicated by arrow 15, suction cup 23 has moved behind pane 13 and tension has been imposed upon line 22 as it is drawn around edge 16 pulling line 22 and drawing tab 21 outwardly from housing 20 and triggering the alarm system. Once tab 21 has been withdrawn, the tension within line 22 is released and tab 21 falls downwardly swinging line 22 in the direction indicated by arrow 38. It should be noted that the would-be intruder cannot reach alarm system housing 20 due to its center position on window pane 13. In any event, once alarm system 10 has been triggered, it is of little, if any, use for the would be intruder to attempt to reinstall tab 21 within housing 20 and thus the most likely consequence of triggering alarm 10 will be to cause the would be intruder to take flight.

Figure 2:
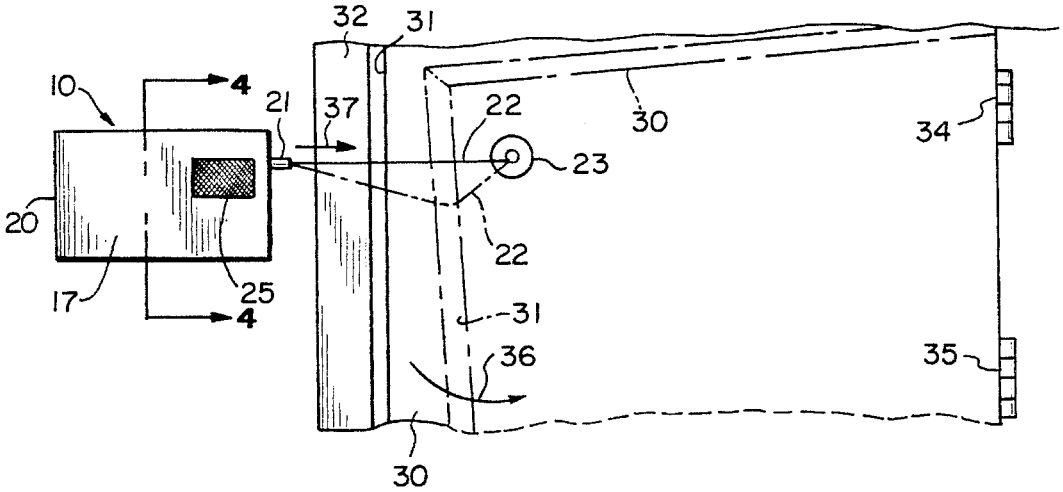
FIG. 2 sets forth an alternative installation of the present invention alarm system.

FIG. 2 sets forth a typical installation of alarm system 10 to protect a typical door against uninvited entry. A typical door 30 is supported relative to a door jam 32 and defines a movable edge 31 and a plurality of hinges 34 and 35. Door 30 is opened by pivoting about hinges 34 and 35 in the direction indicated by arrow 36. A wall surface 33 extends outwardly from door jam 32 in accordance with typical fabrication techniques.

Alarm system 10 is constructed in the manner set forth above and is secured to wall surface 33 adjacent door jam 32 in much the same manner as described above in FIGS. 1A and 1B. By way of further similarity, suction cup 23 is secured to door 30 such that line 22 bridges the junction of movable edge 31 of door 30 and jam 32.

In operation, the attempt by a would be intruder to open door 30 by pivoting door 30 about hinges 34 and 35 in the direction indicated by arrow 36 pivots movable edge 31 thereof toward the dashed line position shown in FIG. 1. In response to such movement, line 22 is drawn tightly assuming the position shown in dashed line representation as movable edge 31 is forced against it. The continued attempted motion of door 30 in the direction of arrow 36 produces increased tension within line 22 and ultimately draws tab 21 outwardly from housing 20 in the direction indicated by arrow 37. Once again, as tab 21 is removed from housing 20, the alarm mechanism within alarm system 10 is activated in the manner described below in FIG. 5 to produce an audible alarm and discourage further intrusion.

Figure 3:
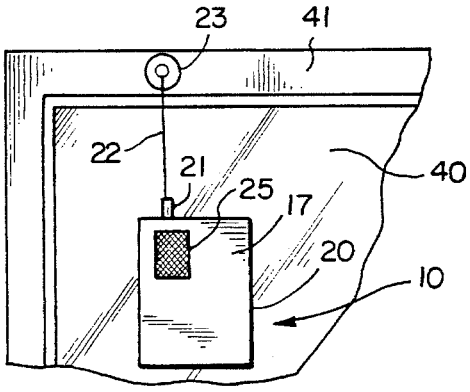
FIG. 3 sets forth a still further alternative installation of the present invention alarm system.

FIG. 3 sets forth a still further alternate configuration of installation which may be utilized in accordance with the present invention alarm system. In the configuration of FIG. 3, a typical door 10 is surrounded by a door molding 41 which is textured to permit the attachment of suction cup 23 thereto. Accordingly, housing 20 may be secured to door 40 in the manner shown in FIG. 3 once again drawing line 22 across the junction between door 40 and frame 41. The operation of alarm system when installed in the manner shown in FIG. 3 responds to the attempted opening of door 40 by again tensioning line 22 and drawing tab 21 outwardly from housing 20 and triggering the audible alarm.

Figure 4:
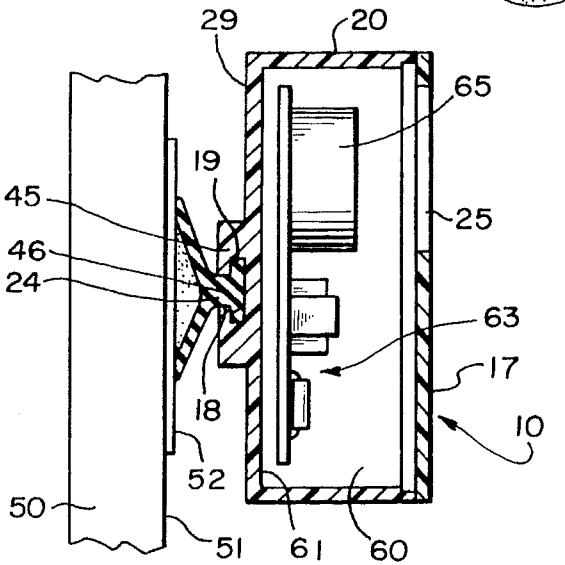
FIG. 4 sets forth a partially sectioned view of an alarm system constructed in accordance with the present invention taken along section lines 4—4 in FIG. 2.

FIG. 4 sets forth a section view of the present invention alarm system taken along section lines 4—4 in FIG. 2. A typical wall 50 defines a wall surface 51. An adhesive plate 52 is secured to surface 51 of wall 50 at the user's option to provide an improved surface for suction cup attachment. It will be apparent to those skilled in the art, however, that in the event wall surface 51 is suitable for suction cup attachment, adhesive plate 52 may be omitted at the user's option and suction cup attachment be carried forward directly to surface 51. Adhesive plate 52 is preferably fabricated of a molded plastic or thin smooth metal material or the like and may be secured to wall 50 using virtually any method of attachment such as adhesive or the like.

Alarm system 10 includes a generally rectangular housing 11 having a cover plate 17 within which a grill 25 is formed. Cover plate 17 may be secured to housing 20 using a conventional snap-fit attachment or other conventional attachment means. Housing 20 further defines a generally planar rear wall 29 having an extending bracket 45 formed therein. Bracket 45 further defines a socket 46. A conventional suction cup 24, preferably formed of a flexible molded plastic material or the like, defines an attachment head 19 and a recessed groove 18. Socket 46 and head 19 together with groove 18 are configured for cooperative engagement whereby head 19 of suction cup 24 is received within socket 46 of bracket 45 to provide a secure attachment between suction cup 24 and housing 20.

Housing 20 further defines an interior cavity 60 having an interior rear surface 61. A printed circuit board 64 is supported within interior cavity 60 near rear surface 61 by conventional attachment means (not shown). Printed circuit board 64 supports an acousto-electric transducer 65 together with a plurality of circuit components such as components 66 through 69 (seen in FIG. 5) which form a conventional alarm circuit whereby an electrical signal is applied to transducer 65 producing an audible sound output signal which propagates outwardly from interior cavity 60 through grill 25 when alarm system 10 is triggered.

Figure 5:
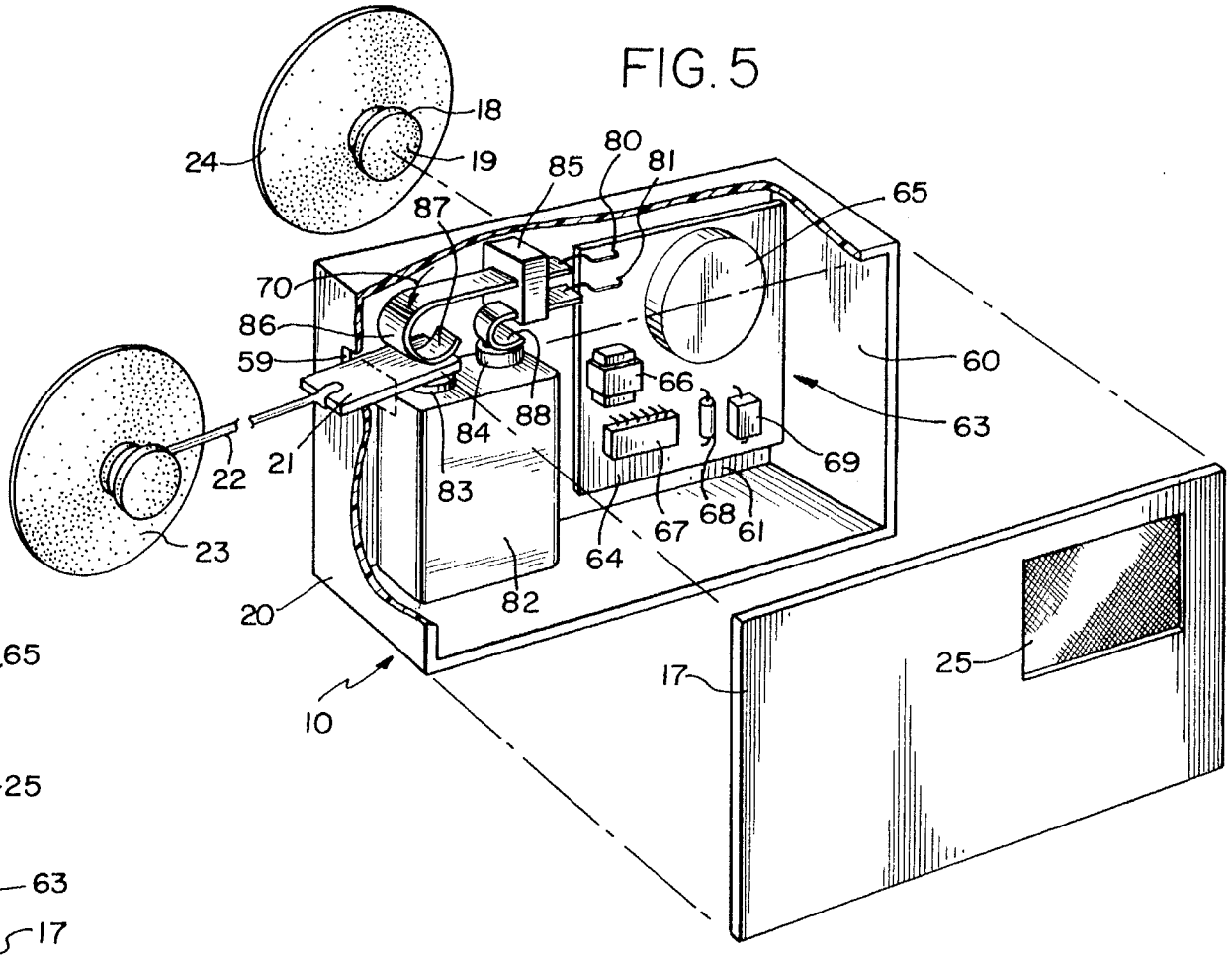
FIG. 5 sets forth a perspective assembly view of a portable alarm system constructed in accordance with the present invention.

FIG. 5 sets forth a perspective assembly view of alarm system 10. Alarm system 10 includes a generally rectangular housing 20 defining an interior cavity 60 and an interior rear surface 61. An alarm circuit 63 constructed in accordance with conventional fabrication techniques includes a printed circuit board 64, an acousto-electric transducer 65 and a plurality of electronic circuit components 66 through 69. Housing 20 further defines an outer edge 62 and a removable cover plate 17. Cover plate 17 is engageable with and securable to edge 62 to complete the closure of interior cavity 60. Cover plate 17 defines a grill 25 having a plurality of apertures therein suitable for permitting sound energy to pass through cover plate 17. A conventional battery 82 is supported within interior cavity 60 by conventional support means (not shown) and includes a pair of battery terminals 83 and 84. A contact support 85 extends forwardly from rear surface 61 of housing 20 and receives and supports a pair of spring metal contacts 86 and 88. Contact 88 defines a generally U-shaped contact element which provides electrical connection between contact 88 and terminal 84 of battery 82. Spring contact 86 includes a curved portion 87 which extends downwardly toward terminal 83. An insulative tab 21 extends through slot 59 of housing 20 and is interposed between terminal 83 of battery 82 and curved portion 87 of spring contact 86. Spring contact 86 provides a resilient spring force which urges curved portion 87 thereof toward terminal 83. But for the interposition of insulating tab 21 between terminal 83 and curved portion 87, spring contact 86 would complete electrical contact with terminal 83. Tab 21 is secured to a flexible line 22 which in turn is secured to a suction cup 23. An additional suction cup 24 is secured to the rear surface 20 in the manner set forth above in FIG. 4 and provides a supportive attachment for housing 20. A pair of electrical connections 80 and 81 couple printed circuit board 64 to spring contacts 86 and 88 respectively.

In operation, insulative tab 21 is positioned in the manner shown in FIG. 5 to provide an interruption in the electrical connection between spring contact 86 and terminal 83 of battery 82. As a result, the power supply to alarm circuit 63 remains interrupted and alarm circuit 63 is inoperative. Once the above-described alarm activation takes place due to tension upon line 22 drawing tab 21 outwardly from housing 20, the spring force of spring contact 86 forces curved portion 87 thereof against terminal 83 completing the battery power circuit for alarm circuit 63. In response, alarm circuit 63 is activated and energizes acousto-electric transducer 65 producing the desired audio alarm output.

It will be apparent to those skilled in the art that alarm circuit 63 may be constructed in accordance with conventional fabrication techniques and may, in its simplest form, comprise a conventional signal oscillator which provides an oscillating signal to energize transducer 65. It will be equally apparent to those skilled in the art, however, that virtually any alarm circuit may be used for circuit 63 to practice the present invention.

What has been shown is a small compact and inexpensive portable alarm system which may be easily carried and which may be temporarily or long term installed at a desirable to-be-protected door or window. The system utilizes a standard alarm circuit and transducer together with a conventional battery such as nine volt rectangular battery. The alarm housing as well as the termination of the alarm triggering line are supported by suction cup attachments which facilitate the installation of the alarm system in a virtually endless variety of orientations and positions. Thus, flexibility is provided by which the system may be utilized in virtually any to-be-protected entry point.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in detecting motion of entryway apparatus, an alarm comprising:

a housing defining an external surface, an interior cavity and an aperture;

a first suction cup secured to said external surface of said housing and having a suction cone facing outwardly with respect to said housing;

an audible alarm circuit supported within said interior cavity;

a battery having first and second terminals forming part of said alarm circuit;

first and second spring connectors forming part of said alarm circuit and biased to be normally coupled to said first and second battery terminals respectively;

a tab having a first end extending partially into said interior cavity through said aperture so as to be positioned between said first spring connector and said first battery terminal thereby precluding electrical connection therebetween and a second end external to said housing;

a second suction cup; and a flexible line coupled between said second end of said tab and said second suction cup.

2. An alarm as set forth in claim 1 wherein said first and second spring connectors each include a metal member having a curved contact end proximate said first and second battery terminals respectively.

3. An alarm as set forth in claim 1 wherein said housing defines a rear surface having means for attaching said first suction cup thereto.

4. An alarm as set forth in claim 3 wherein said first and second spring connectors are formed of spring steel.

5. An alarm as set forth in claim 3 wherein said first suction cup defines a head portion and wherein said means for attaching includes a socket for receiving said head portion.

6. An alarm as set forth in claim 1 further including a plate having an adhesively coated portion, for attachment of the plate to a portion of said entryway apparatus selected as a mounting surface for said housing, and said plate further having a smooth surface for attachment of said suction cone thereto.

* * * * *